US006654478B2

(12) United States Patent
Tsuchikiri et al.

(10) Patent No.: US 6,654,478 B2
(45) Date of Patent: Nov. 25, 2003

(54) ELECTROACOUSTIC TRANSDUCER

(75) Inventors: Yoshikazu Tsuchikiri, Sizuoka (JP); Yoshiharu Oishi, Sizuoka (JP); Yoichi Gotoh, Shizuoka (JP)

(73) Assignee: Star Micronics Co., Ltd., Shizoka (JP)

( * ) Notice: Subject to any disclaimer, the term of this patent is extended or adjusted under 35 U.S.C. 154(b) by 0 days.

(21) Appl. No.: 10/012,496

(22) Filed: Dec. 12, 2001

(65) Prior Publication Data

US 2002/0076079 A1 Jun. 20, 2002

(30) Foreign Application Priority Data

Dec. 15, 2000 (JP) ..... P. 2000-382286
Dec. 15, 2000 (JP) ..... P. 2000-382297

(51) Int. Cl.[7] ..... H04R 25/00
(52) U.S. Cl. ..... 381/412; 381/407
(58) Field of Search ..... 381/396, 412, 381/431, 407, FOR 159; 340/388.1, 391.1, 396.1

(56) References Cited

U.S. PATENT DOCUMENTS 2,271,525 A * 2/1942 Seabert
2,699,472 A * 1/1955 Olson et al.
5,394,479 A * 2/1995 Ishigaya et al.
5,894,263 A * 4/1999 Shimakawa et al.

FOREIGN PATENT DOCUMENTS

| | | |
|---|---|---|
| EP | 0 706 300 A2 | 4/1996 |
| JP | 3-240399 | * 10/1991 |
| JP | 8-6558 | 1/1996 |
| JP | 8-186895 | 7/1996 |
| JP | 9-179562 | 7/1997 |

* cited by examiner

*Primary Examiner*—Sinh Tran
(74) *Attorney, Agent, or Firm*—Sughrue Mion, PLLC

(57) ABSTRACT

A pole piece 31 is placed on a lower case 21. A pole piece 31 has a core 32 and a base 33. The bobbin portion 24 extends from the lower case 21 toward the internal space of a case 1 so as to surround the outer periphery of the core 32. The bobbin portion 24 is divided into a plurality of portions along the circumferential direction of the core 32. The bobbin portion 24 has basal parts 26 and elongated parts 27. The pole piece 31 is pressed from the above of the lower case 21 in a state where the bobbin portion 24 is passed through holes 35 of the base 33, to be positioned on the outer periphery of the core 32, so that the pole piece is fitted and placed into the lower case 21. A coil 41 is configured by winding a conductor wire 42 around the elongated parts 27 of the bobbin portion 24.

5 Claims, 9 Drawing Sheets

ELECTROACOUSTIC TRANSDUCER

BACKGROUND OF THE INVENTION

1. Field of the Invention

The present invention relates to an electroacoustic transducer which transduces an electrical signal into a sound.

2. Description of the Related Art

JP-A-8-6558 discloses an electroacoustic transducer which comprises a case in which a pole piece is mounted. The pole piece comprises a base and a core fixed integrally to each other. A coil is placed on the side of the outer periphery of the core. A magnet is placed around the coil with a gap formed therebetween. The coil is placed by directly winding a conductor wire around the core, or by mounting a prewound coil to the core.

However, the following problems arise in the electroacoustic transducer during a step of placing the coil. When the conductor wire is directly wound around the core, there is a possibility that the conductor wire (insulating layer thereof) is damaged by the core which is made of a metal. Also, when a prewound coil is attached to the core, there is a possibility that the core rubs against the conductive wire, damaging the wire, particularly the insulating layer thereof. When the conductor wire (insulating layer thereof) is damaged in this way, the conductor wire may be in contact with a metal portion such as the core to cause a short circuit, thereby lowering the reliability and durability of the electroacoustic transducer.

It may be contemplated to provide an additional part around which a conductor wire is to be wound. In this case, the production cost is increased by the additional part, and a step of attaching the additional part is additionally required.

Moreover, the additional part reduces the capacity of the back space of the electroacoustic transducer. Accordingly, the sound pressure characteristic, particularly that in the bass region is lowered.

SUMMARY OF THE INVENTION

The invention has been made in view of these problems. It is an object of the invention to provide an electroacoustic transducer in which, during a step of placing a coil, a conductor wire can be prevented from being damaged without increasing the production cost and the manufacturing steps and reductions in reliability and durability can be suppressed.

According to an aspect of the invention, there is provided an electroacoustic transducer comprising:

a pole piece having a base and a core;

a coil disposed around the core;

a magnet disposed around the coil; and a case made of a resin material, the case accommodating the pole piece, the coil, and the magnet in an internal space thereof, wherein a bobbin portion is formed integrally with the case, the bobbin portion elongating toward the internal space of the case; and the coil is configured by winding a conductor wire around the bobbin portion.

In the electroacoustic transducer of the invention, the bobbin portion is formed integrally with the case which is made of a resin material, and the conductor wire is wound around the bobbin portion to configure the coil. Since the bobbin portion is made of the same resin material as the case, it is possible to prevent the conductor wire (covering layer thereof) from being damaged during a step of winding the conductor wire around the bobbin portion. This configuration prevents a short circuit possibly caused by a damaged conductor wire (coil) being in contact with a metal portion such as the core, and hence it is possible to suppress reductions of the reliability and durability of the electroacoustic transducer.

In the electroacoustic transducer of the invention, since the bobbin portion is formed integrally with the case, another member for winding the conductor wire is not additionally required. Therefore, it is possible to realize simply and at a low cost a configuration in which the bobbin portion can be provided without increasing the production cost and the manufacturing steps, and the conductor wire (covering layer thereof) can be prevented from being damaged.

Preferably, the case comprises an upper case, and a lower case having a coil terminal portion to which an end of the conductor wire is electrically connected, and the bobbin portion is formed integrally with the lower case.

Since the case is configured in this way, the bobbin portion which extends into the internal space of the case can be easily formed.

Preferably, the bobbin portion extends from the lower case to surround the outer periphery of the core, and the base is placed on the lower case, and has a hole through which the bobbin portion is passed.

Since the bobbin portion is formed in this way, it is possible to realize very simply a configuration in which the base can be easily placed on the lower case without interfering with the bobbin portion.

According to another aspect of the present invention, there is provided an electroacoustic transducer comprising:

a pole piece having a base and a core;

a bobbin portion placed to surround an outer periphery of the core;

a coil formed of a conductor wire wound around the bobbin portion; and a magnet placed around the coil, wherein the bobbin portion is divided into a plurality of portions along a circumferential direction of the core.

In the electroacoustic transducer of the invention, since the coil is configured by winding the conductor wire around the bobbin portion, it is possible to prevent the conductor wire (covering layer thereof) from being damaged during a step of winding the conductor wire. This configuration prevents a short circuit possibly caused by a damaged conductor wire (coil) being in contact with the core. As a result, it is possible to suppress reductions of the reliability and durability of the electroacoustic transducer.

In the electroacoustic transducer of the invention, since the bobbin portion is divided into plural parts along the circumferential direction of the core, the bobbin portion is intermittently placed as viewed along the circumferential direction of the core, and hence the capacity of the bobbin portion can be reduced. Therefore, a reduction of the capacity of the back space of the electroacoustic transducer can be suppressed as far as possible, so that the sound pressure characteristic can be prevented from being lowered.

Preferably, the transducer further comprises a case comprising: an upper case; and a lower case having a coil terminal portion to which an end of the conductor wire is electrically connected, and the bobbin portion is formed integrally with the lower case.

Since the transducer further comprises a case configured in this way, another part for winding the conductor wire is not additionally required. Therefore, it is possible to realize simply and at a low cost a configuration in which the bobbin portion can be disposed without increasing the production cost and the manufacturing steps, and the conductor wire (covering layer thereof) can be prevented from being damaged.

Preferably, the bobbin portion extends from the lower case to surround the outer periphery of the core, and the core is pressed against the bobbin portion. Since the bobbin portion is formed in this way, the pole piece can be prevented from being detached from the lower case.

Preferably the base is placed on the lower case, and has a hole through which the bobbin portion is passed. Accordingly, it is possible to realize very simply a configuration in which the base can be easily placed on the lower case without interfering with the bobbin portion.

DETAILED DESCRIPTION OF THE PRESENT INVENTION

Figure 1:
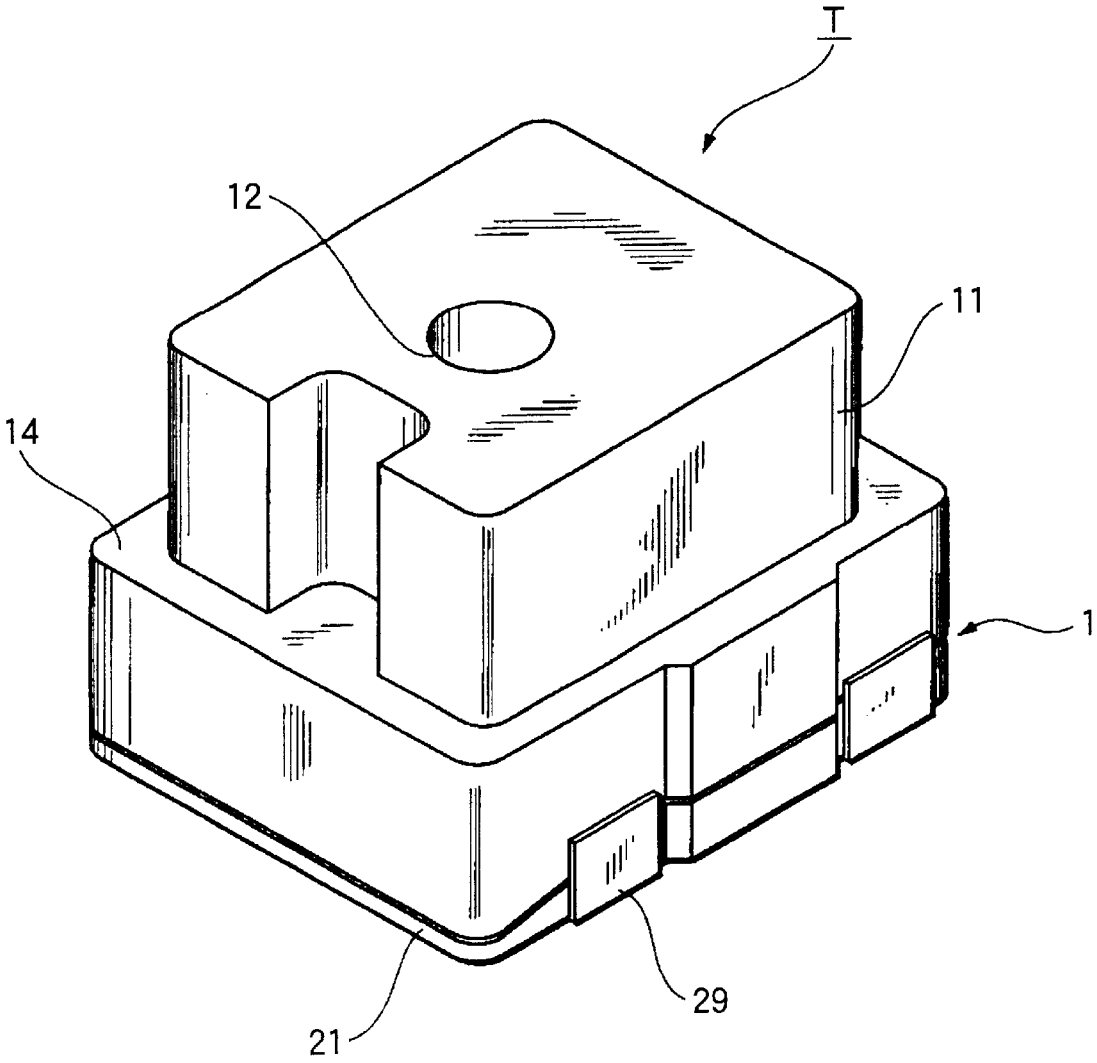
FIG. 1 is a perspective view showing the whole appearance of an electroacoustic transducer according to an embodiment of the invention.

The present invention will be described in detail with reference to the accompanying drawings. In the description of the drawings, the identical components are denoted by the same reference numerals, and duplicated description is omitted.

Figure 2:
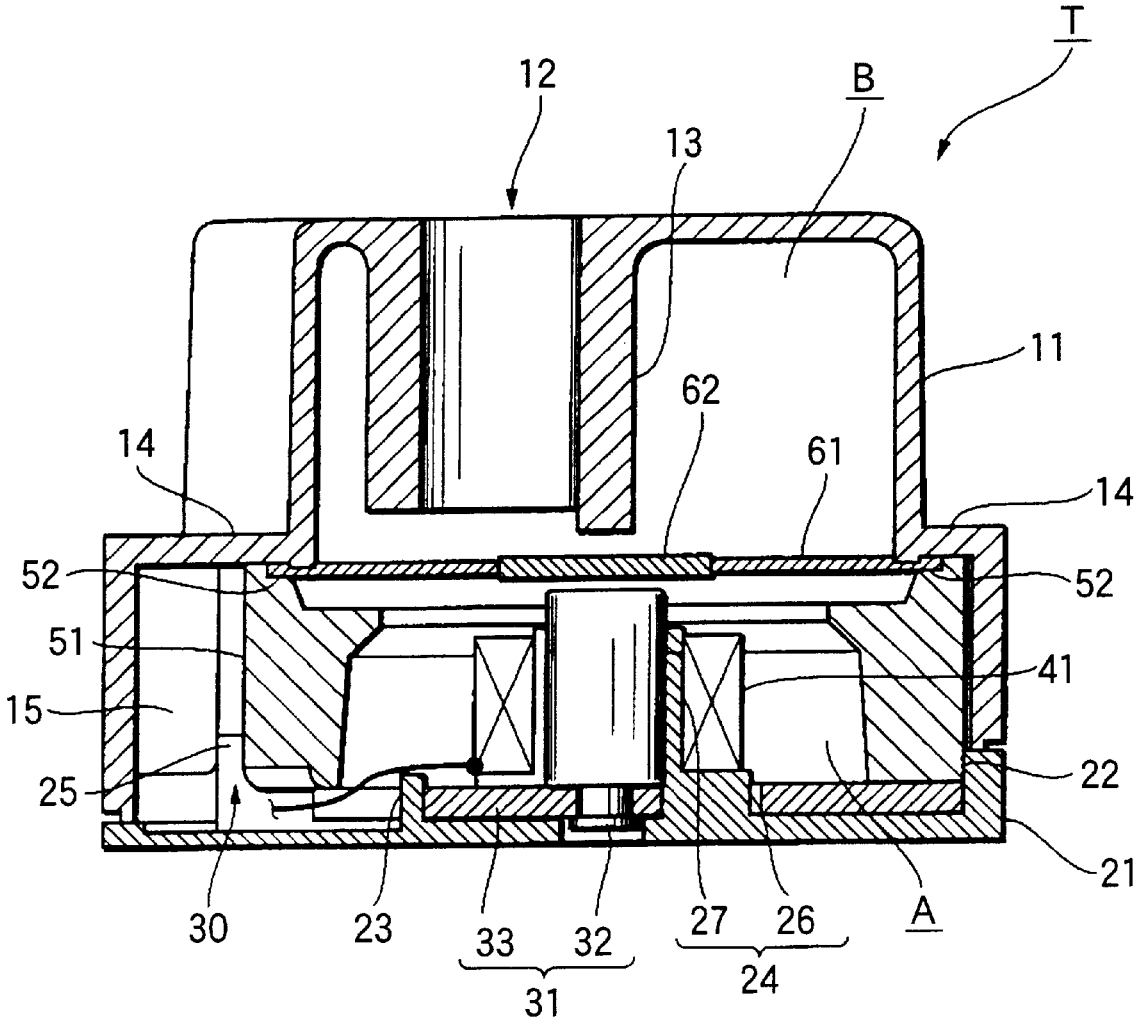
FIG. 2 is a section view showing the electroacoustic transducer according to the embodiment of the invention.
Figure 3:
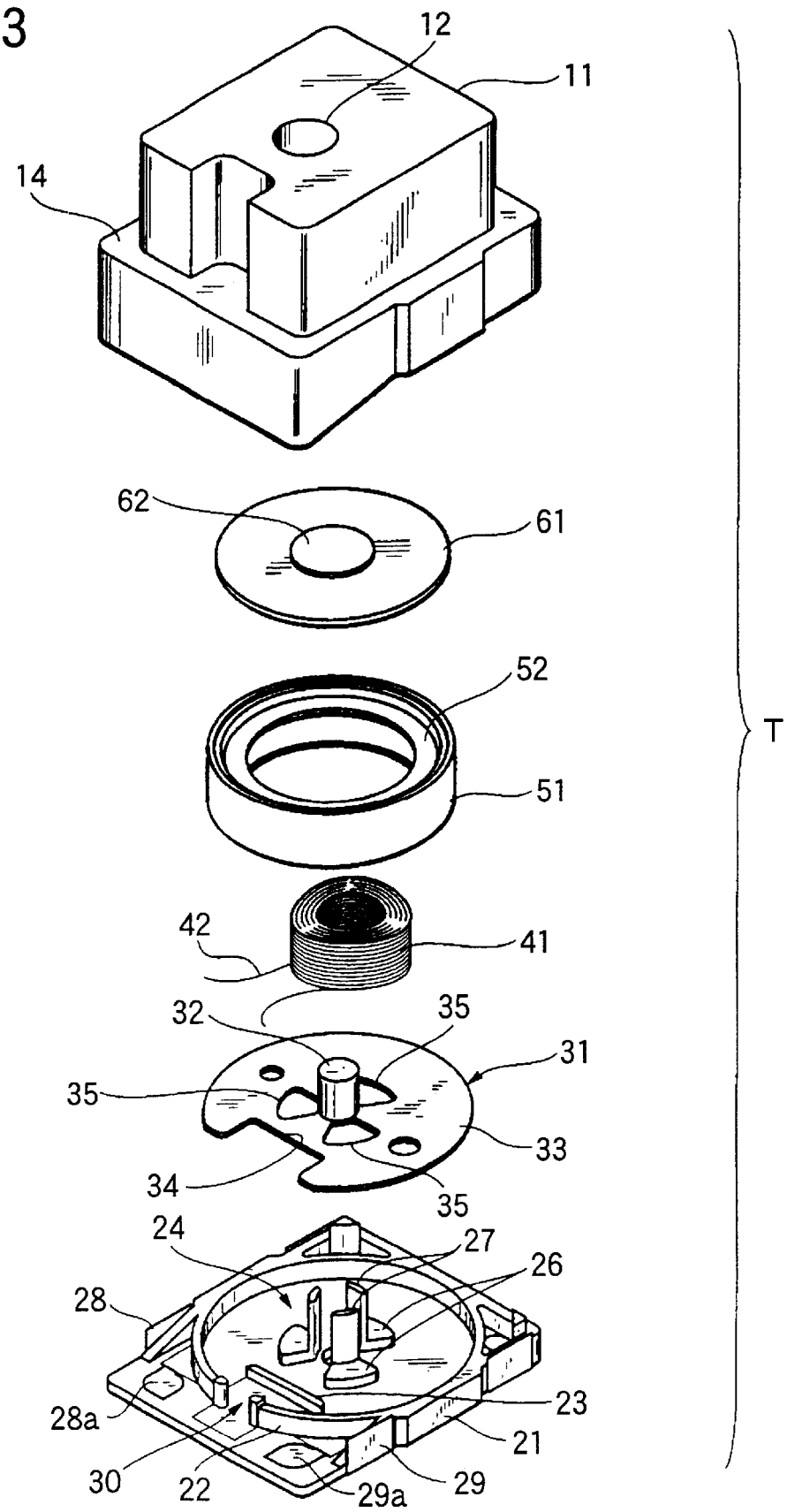
FIG. 3 is an exploded perspective view showing the configuration of the electroacoustic transducer according to the embodiment of the invention.

FIG. 1 is a perspective view showing the whole appearance of an electroacoustic transducer of the embodiment of the invention. FIG. 2 is a section view showing the electroacoustic transducer. FIG. 3 is an exploded perspective view showing the configuration of the electroacoustic transducer.

The electroacoustic transducer T has a case 1 made of a thermoplastic resin. The case 1 includes an upper case 11 and a lower case 21 which are bonded and fixed to each other by using the ultrasonic welding technique. The upper case 11 has a substantially box-like shape in which the lower face is opened. The upper case 11 has a sound release opening 12 in the upper face thereof and a sound release tube 13 extending toward the inside thereof. The upper case 11 has a stepped portion 14 against which an ultrasonic welder is to abut. A pole piece 31, a coil 41, a magnet 51, a diaphragm 61, and others are housed in the internal space defined by the upper case 11 and the lower case 21.

Figure 4:
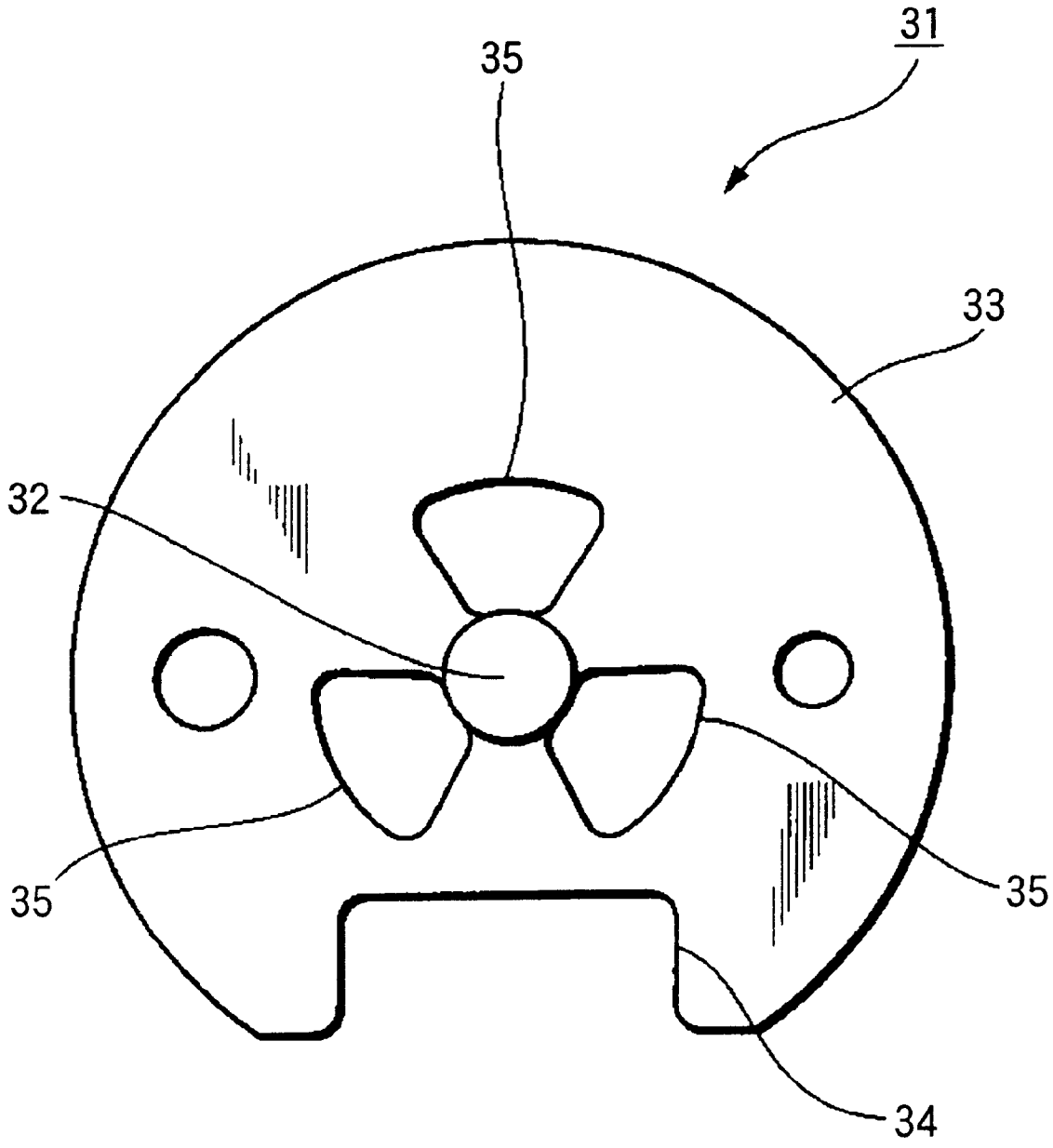
FIG. 4 is a plan view of a pole piece included in the electroacoustic transducer according to the embodiment of the invention.
Figure 5:
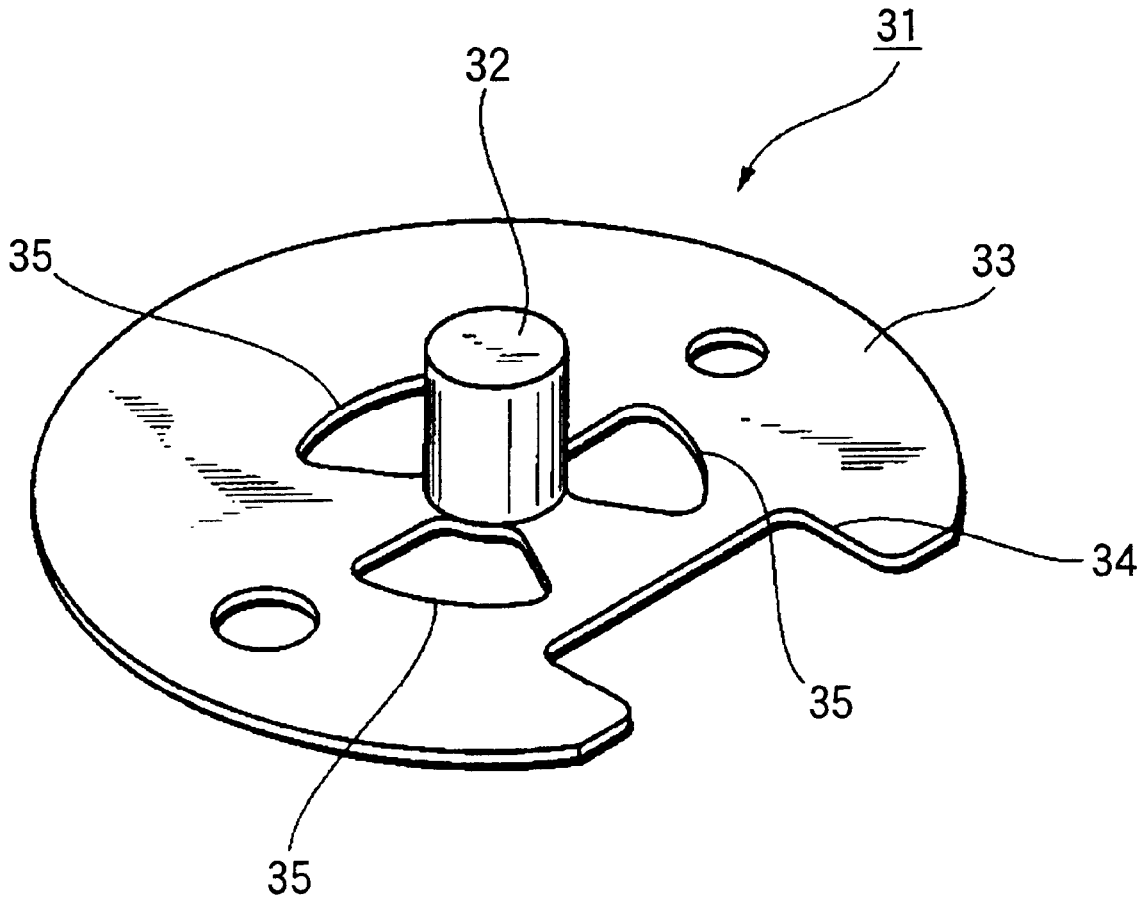
FIG. 5 is a perspective view of the pole piece included in the electroacoustic transducer according to the embodiment of the invention.

The pole piece 31 is placed on the lower case 21. As shown in FIGS. 4 and 5, the pole piece 31 has a core 32 having a substantially columnar shape, and a base 33 made of a metal material (for example, permalloy). The core 32 is caulked and integrally fixed to the center position of the base 33. A cutaway portion 34 is formed in a predetermined position of the edge of the base 33. A plurality of holes 35 (three in the embodiment) are formed in the base 33 so as to surround the portion to which the core 32 is fixed. A bobbin portion 24 that will be described later is to be passed through the plurality of holes 35. In the embodiment, the base 33 is set to have a thickness of about 0.6 mm, and the length (the height) of the core 32 from the upper face of the base 33 is set to be about 3.8 mm.

Figure 6:
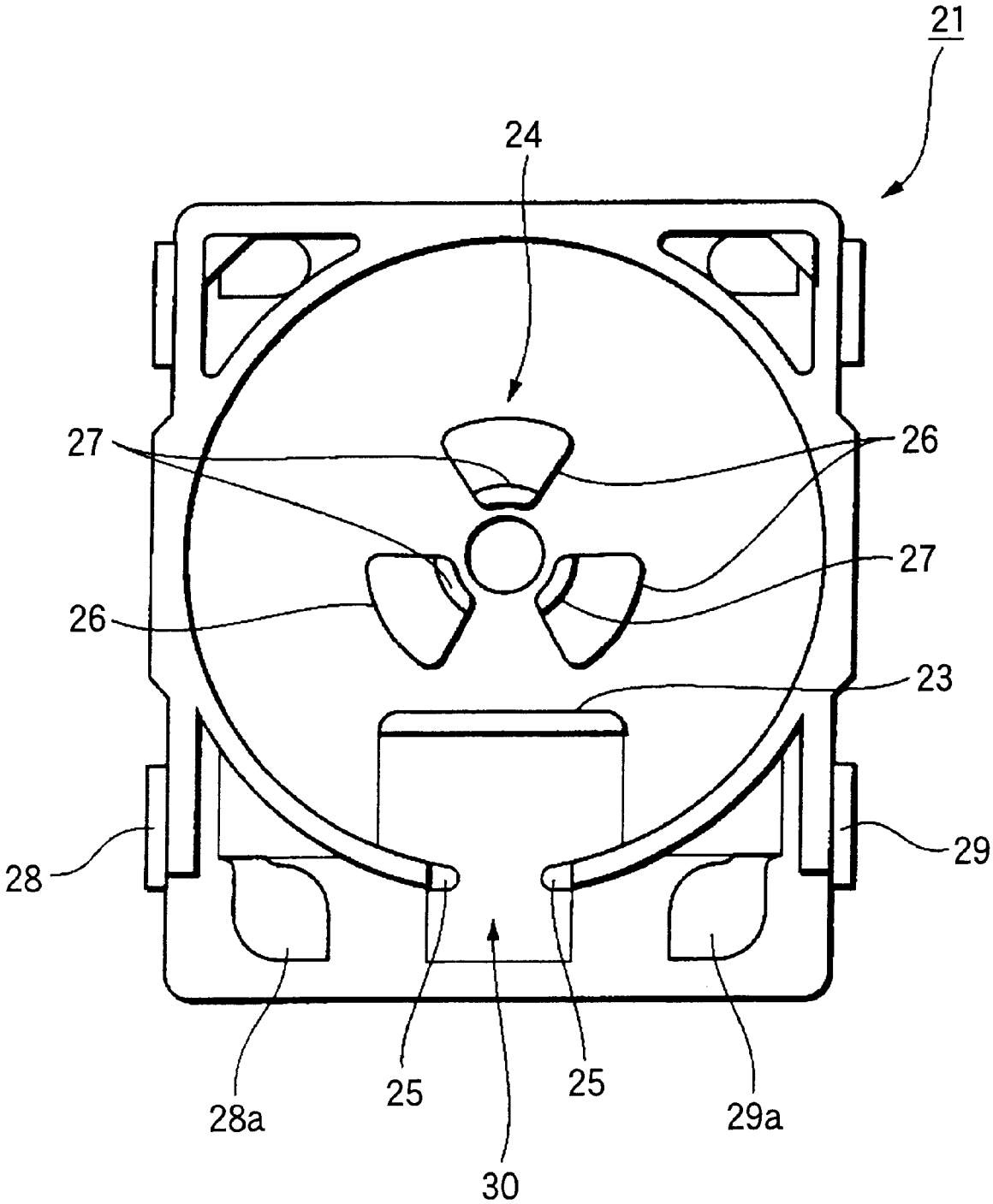
FIG. 6 is a plan view of a lower case included in the electroacoustic transducer according to the embodiment of the invention.
Figure 7:
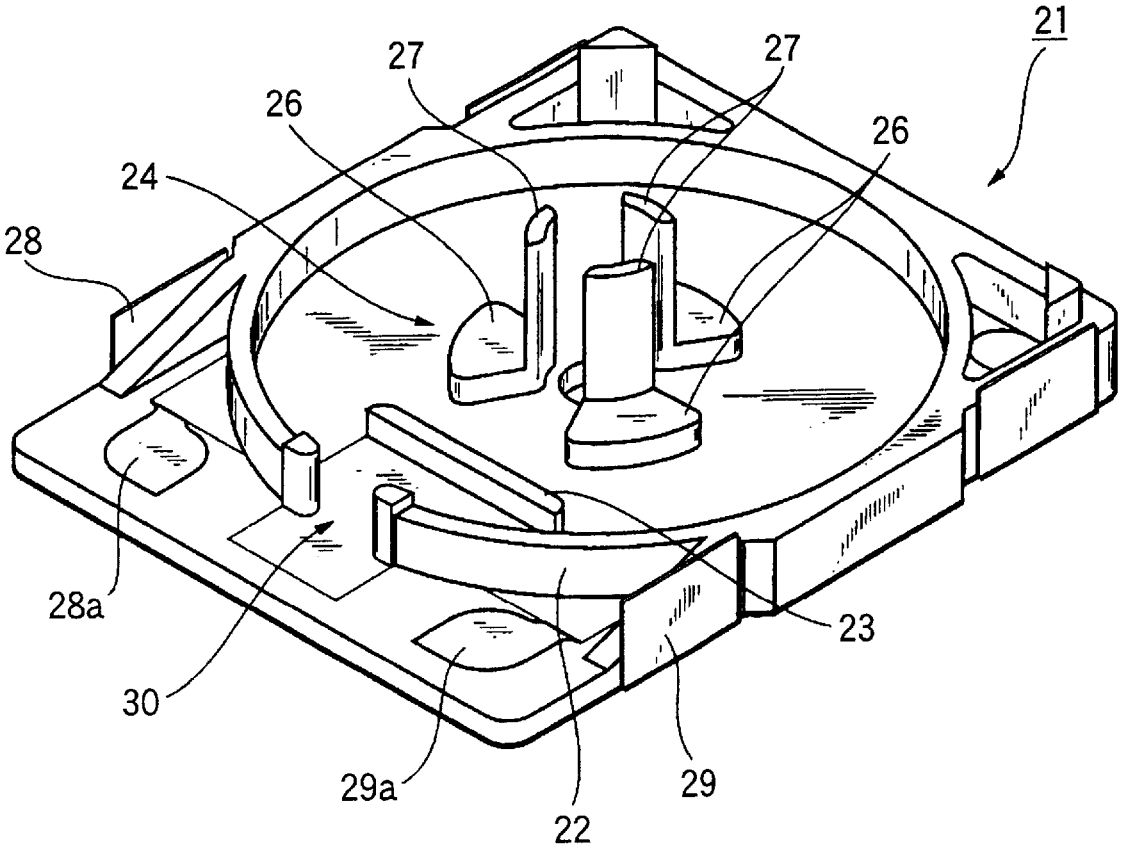
FIG. 7 is a perspective view of the lower case included in the electroacoustic transducer according to the embodiment of the invention.

As shown in FIGS. 6 and 7, integrally formed on the upper face of the lower case 21 are a wall 22 for defining the placement position of the pole piece 31, a projection 23 engageable with the cutaway portion 34 of the base 33, and the bobbin portion 24 for configuring the coil 41. Formed at the wall 22 are projections 25 being engageable with a projection 15 formed on the upper case 11. When the projections 25 and 15 are engaged with each other, the upper case 11 is positioned with respect to the lower case 21. Each of the wall 22 and the projection 23 is set to have a height larger than the thickness of the base 33. In the embodiment, the height of the wall 22 is set to be about 1.2 mm, and that of the projection 23 to be about 0.8 mm.

The bobbin portion 24 extends from the upper face of the lower case 21 toward the internal space of the case 1 so as to surround the outer periphery of the core 32. The bobbin portion is divided into plural parts (three in the embodiment) along the circumferential direction of the core 32. The bobbin portion 24 is configured by basal parts 26 and elongated parts 27. The basal parts 26 are set to have a height (in the embodiment, about 0.85 mm) larger than the thickness of the base 33. The length of each elongated part 27 is set to have a value (in the embodiment, about 2.95 mm) at which the top of the core 32 protrudes from the end of the elongated part 27 in a state where the pole piece 31 is placed on the lower case 21. The inner diameter of the bobbin portion 24 (the basal parts 26) is set to have a value (in the embodiment, about 2.2 mm) approximately equal to the outer diameter of the core 32.

The face of each basal part 26 on the side of the core 32 is curved so as to extend along the outer periphery of the core 32. In each elongated part 27, also both the face on the side of the core 32, and the rear face (the face on the side where a conductor wire 42 is to be wound) are curved so as to extend along the outer periphery of the core 32. The sectional area of the basal parts 26 is set to be larger than that of the elongated parts 27. According to this configuration, it is possible to ensure the mechanical strength of the bobbin portion 24, so that the bobbin portion 24 is prevented from being detached from the lower case 21.

The pole piece 31 (the base 33) is pressed from the above of the lower case 21 in a state where the bobbin portion 24 (the elongated parts 27) is passed through the holes 35 of the base 33 to be positioned on the outer periphery of the core 32, whereby the pole piece is fitted and placed into the lower case 21. At this time, the positioning of the pole piece 31 with respect to the lower case 21 is performed by engaging the cutaway portion 34 of the base 33 with the projection 23 of the lower case 21. Under a state where the pole piece 31 is fitted into the lower case 21, the core 32 is pressed against the bobbin portion 24 because the inner diameter of the bobbin portion 24 (the basal parts 26) is set to have a value which is approximately equal to the outer diameter of the core 32. As a result, the pole piece 31 is hardly detached from the lower case 21.

Figure 8:
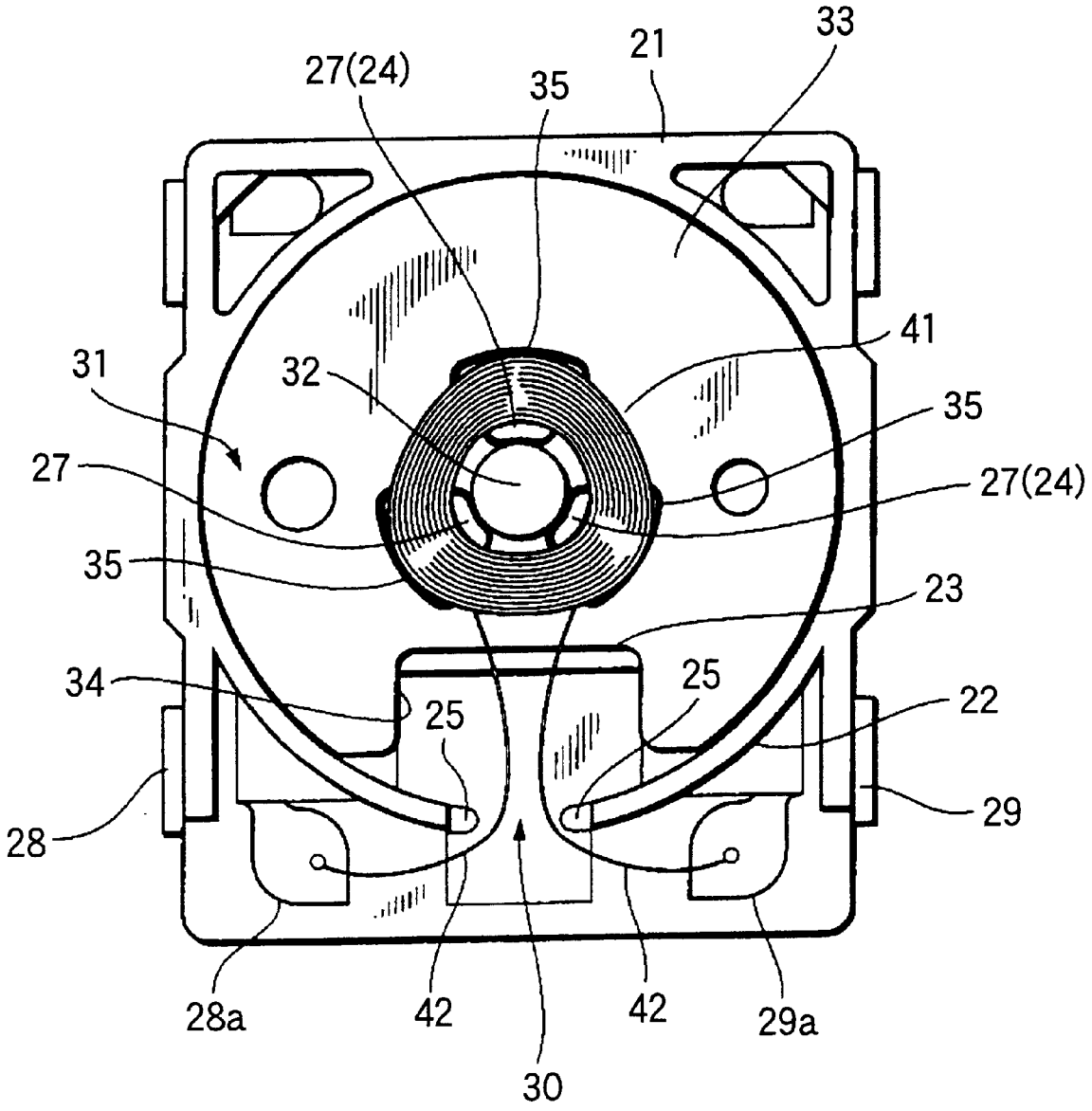
FIG. 8 is a plan view showing a state where electroacoustic transducer where a conductor wire is wound around a bobbin portion to constitute a coil.
Figure 9:
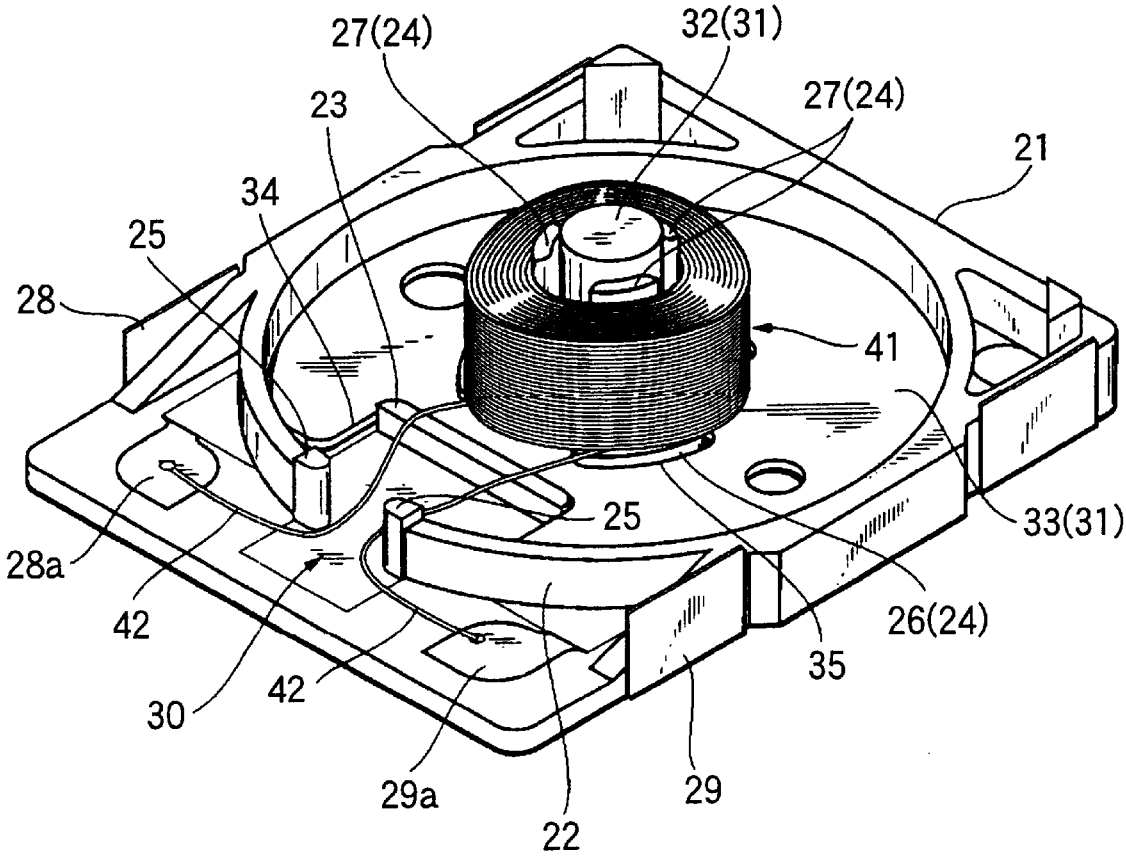
FIG. 9 is a perspective view showing the state where the conductor wire is wound around the bobbin portion to constitute the coil.

As shown also in FIGS. 8 and 9, the coil 41 is configured by winding the conductor wire 42 around the elongated parts 27 of the bobbin portion 24, and placed on the basal parts 26. In the embodiment, a copper wire of a diameter of about 60 μm is used as the conductor wire 42. An insulating layer is disposed on the outer periphery of the copper wire. The height of the coil is set to a value (in the embodiment, about 2.9 mm) smaller than the length of each elongated part 27.

The basal parts 26 are set to have a height larger than the thickness of the base 33 so that the coil 41 does not abut against the base 33 (the pole piece 31). The bobbin portion 24 (the elongated parts 27) is divided into the plural parts along the circumferential direction of the core 32 so that the bobbin portion 24 (the elongated parts 27) is intermittently placed as viewed along the circumferential direction of the core 32. The conductor wire 42 is linearly wound between the divided parts of the bobbin portion 24.

In the lower case 21, lead terminals 28 and 29 serving as terminals of the coil 41 are disposed in an integral manner by so-called "insert molding". As shown in FIGS. 8 and 9, the ends of the conductor wire 42 constituting the coil 41 are passed over the projection 23 formed on the lower case 21, and then drawn out through a cutaway portion 30 formed in the wall 22, onto lands 28*a* and 29*a* of the lead terminals 28 and 29, respectively. Under this state, the ends are soldered to the lands 28*a* and 29*a*. The cutaway portion 30 formed in the wall 22 is sealed by a silicone material (not shown).

Referring again FIGS. 2 and 3, the magnet 51 is configured by an annular plastic magnet, and placed on the side of the outer periphery of the coil 41 with a gap provided between the magnet and the coil 41. The magnet 51 is placed against the base 33 of the pole piece 31, and against the wall 22 of the lower case 21, thereby restricting the placement position of the magnet.

A stepped portion 52 is formed in the magnet 51. The diaphragm 61 is placed on the stepped portion 52. In the embodiment, the magnet 51 functions also as a support member which supports the diaphragm 61. A magnetic piece 62, serving as an additional mass, is disposed in a center portion of the diaphragm 61. The diaphragm 61 is caused to be attracted toward the magnet 51 by function of the static magnetic field of the magnet 51. The upward movement of the diaphragm 61 is restricted by the stepped portion 14 of the upper case 11.

A back space A is formed on the side of the back face of the diaphragm 61. A resonant space B surrounded by the upper case 11 is formed on the side of the upper face of the diaphragm 61. The resonant space B is opened to the outside through the sound release tube 13 formed on the upper case 11, i.e., the sound release opening 12.

Then, the operation of the electroacoustic transducer T of the invention will be described. In the electroacoustic transducer T, the base 33, the core, 32, the diaphragm 61, and the magnet 51 constitute a magnetic circuit, and the static magnetic field generated by the magnet 51 acts on the diaphragm 61, so that the magnetized diaphragm 61 is attracted toward the core 32. The magnet 51 functions so as to generate a bias magnetic field for the diaphragm 61.

In contrast to the unidirectional magnetic field due to the static magnetic field, when an electric signal in the form of AC, pulses or the like is applied between the lead terminals 28 and 29, the signal current flows through the coil 41, and an oscillating magnetic field corresponding to the electric signal is generated in the core 32. When the direction of the oscillating magnetic field is opposite to that of the static magnetic field of the magnet 51, the diaphragm 61 swings in the direction away from the core 32. When the direction of the oscillating magnetic field coincides with that of the static magnetic field, the diaphragm is attracted toward the core 32. Such mechanical vertical movements depend on the frequency of the electric signal, with the result that the diaphragm 61 vibrates to cause air to oscillate. This oscillation is amplified as a resonant sound by the resonant space B. This sound is released mainly through the sound release opening 12 to the outside.

In the embodiment, as described above, the bobbin portion 24 (the basal parts 26 and the elongated parts 27) is formed integrally with the lower case 21 (the case 1) made of a resin material (thermoplastic resin), and the conductor wire 42 is wound around the bobbin portion 24 (the elongated parts 27), whereby the coil 41 is configured. It is possible to prevent the conductor wire 42, particularly the covering layer (insulating layer) thereof from being damaged during a step of winding the conductor wire 42 around the bobbin portion 24 (the elongated parts 27), since the bobbin portion 24 (the elongated parts 27) is made of the same resin material as the lower case 21 (the case 1). As a result, this prevents a short circuit possibly caused by a damaged conductor wire 42 (coil 41) being in contact with a metal portion such as the core 32. It is possible to suppress reductions in reliability and durability of the electroacoustic transducer T.

The bobbin portion 24 (the basal parts 26 and the elongated parts 27) and the lower case 21 (the case 1) can be molded at one time because the bobbin portion 24 (the basal parts 26 and the elongated parts 27) is formed integrally with the lower case 21 (the case 1). Accordingly, Another part for winding the conductor wire 42 is not additionally required. Therefore, it is possible to realize simply and at a low cost a configuration in which the bobbin portion 24 can be disposed without increasing the production cost and the manufacturing steps, and the conductor wire 42 (covering layer thereof) can be prevented from being damaged.

Since the bobbin portion 24 (the basal parts 26 and the elongated parts 27) is divided into plural parts along the circumferential direction of the core 32, the bobbin portion 24 (the basal parts 26 and the elongated parts 27) is intermittently placed as viewed along the circumferential direction of the core 32, and hence the capacity of the bobbin portion 24 can be reduced. Therefore, a reduction of the capacity of the back space A of the electroacoustic transducer T can be suppressed as far as possible, so that the sound pressure characteristic can be prevented from being lowered.

Moreover, the conductor wire 42 is linearly wound between the divided parts of the bobbin portion 24 (the elongated parts 27). According to this configuration, even when vibrations of any kind are transmitted to the coil 41 as in the case where the upper case 11 and the lower case 21 are ultrasonic welded together, movement of the coil 41 around the bobbin portion 24 is restricted, including a movement of the coil 41 toward the center axis of the core 32. As a result, it is possible to prevent the conductor wire 42 constituting the coil 41, from being damaged or broken.

The case 1 comprises the upper case 11; and the lower case 21 in which the lead terminals 28 and 29 are disposed. The bobbin portion 24 (the basal parts 26 and the elongated parts 27) is formed integrally with the lower case 21, the bobbin portion 24 (the basal parts 26 and the elongated parts 27) and the lower case 21 (the case 1) can be molded at one time, and hence another part for winding the conductor wire 42 is not additionally required. Therefore, it is possible to realize simply and at a low cost a configuration in which the bobbin portion 24 can be provided without increasing the production cost and the manufacturing steps, and the conductor wire 42 (covering layer thereof) can be prevented from being damaged.

The bobbin portion 24 (the basal parts 26 and the elongated parts 27) is extends from the lower case 21 so as to surround the outer periphery of the core 32, and the core 32 is pressed against the bobbin portion 24. Therefore, the pole piece 31 can be prevented from being detached from the lower case 21, by the simple configuration.

The base 33 of the pole piece 31 has the holes 35 through which the bobbin portion 24 (the basal parts 26 and the elongated parts 27) is to be passed. When the pole piece 31 is fitted and placed into the lower case 21, therefore, the bobbin portion 24 (the basal parts 26 and the elongated parts 27) does not interfere with the base 33. As a result, it is possible to realize very simply a configuration in which the pole piece 31 can be easily placed on the lower case 21.

The invention is not restricted to the embodiment described above. The above-mentioned values, and the shape of each component, and the like (for example, the shape and number of divisions of the bobbin portion 24) can be set with being suitably changed. In the embodiment, the bobbin portion 24 is configured by the basal parts 26 and the elongated parts 27. The configuration of the bobbin portion is not limited thereto. Alternatively, the bobbin portion may be configured by only parts corresponding to the elongated parts 27.

In the embodiment, the bobbin portion 24 is formed integrally with the lower case 21 (the case 1). The invention is not restricted thereto. For example, the bobbin portion 24 may be formed separately from the lower case 21 (the case 1), and then attached and fixed to the lower case 21 by bonding or the like.

In the embodiment, the pole piece 31 is placed on the lower case 21 by means of fitting. The manner of the placement is not restricted thereto. For example, the pole piece 31 may be disposed integrally on the lower case 21 by the insert molding in the same manner as the lead terminals 28 and 29. In this case, the bobbin portion 24 is formed so as to cover the outer periphery of the core 32 of the pole piece 31.

As described above in detail, according to the invention, it is possible to provide an electroacoustic transducer in which, during a step of placing a coil, a conductor wire can be prevented from being damaged, without increasing the production cost and the manufacturing steps, and reductions in reliability and durability can be suppressed.

What is claimed is:

1. An electroacoustic transducer comprising:

a pole piece having a base and a core;

a bobbin portion placed to surround an outer periphery of the core;

a coil formed of a conductor wire wound around the bobbin portion; and a magnet placed around the coil, wherein the bobbin portion is divided into a plurality of unattached individual portions along a circumferential direction of the core.

2. The electroacoustic transducer according to claim 1, wherein the transducer further comprises a case comprising:

an upper case; and a lower case having a coil terminal portion to which an end of the conductor wire is electrically connected, and the bobbin portions are formed integrally with the lower case.

3. The electroacoustic transducer according to claim 2, wherein the bobbin portions extend from the lower case to surround the outer periphery of the core, and the core is pressed against the bobbin portions.

4. The electroacoustic transducer according to claim 3, wherein the base is placed on the lower case, and has holes through which the bobbin portions are passed.

5. The electroacoustic transducer according to claim 2, wherein the base is placed on the lower case, and has holes through which the bobbin portions are passed.

* * * * *